US009551102B2

(12) United States Patent
Emery et al.

(10) Patent No.: US 9,551,102 B2
(45) Date of Patent: Jan. 24, 2017

(54) LAUNDRY TREATING APPLIANCE

(71) Applicant: Whirlpool Corporation, Benton Harbor, MI (US)

(72) Inventors: Adam J. Emery, Eau Claire, MI (US); Steven Fricke, Saint Joseph, MI (US); James R. Sawyer, Monticello, IN (US); Dennis J. Tuckowski, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 433 days.

(21) Appl. No.: 13/916,928

(22) Filed: Jun. 13, 2013

(65) Prior Publication Data

US 2014/0368098 A1 Dec. 18, 2014

(51) Int. Cl.
*D06F 37/26* (2006.01)
*D06F 39/12* (2006.01)

(52) U.S. Cl.
CPC ..... *D06F 37/267* (2013.01); *D06F 39/12* (2013.01); *D06F 39/125* (2013.01)

(58) Field of Classification Search
CPC ..... D06F 39/12; D06F 23/04
USPC ..... D32/6
See application file for complete search history.

(56) References Cited

U.S. PATENT DOCUMENTS 8,056,172 B2 11/2011 Schneider et al.
2005/0257326 A1* 11/2005 Schneider ..... A47L 15/4255 8/159
2011/0227462 A1* 9/2011 Bohm ..... A47L 15/4255 312/204
2013/0036776 A1* 2/2013 Seo ..... D06F 23/04 68/18 F

FOREIGN PATENT DOCUMENTS

DE 102009027614 A1 1/2011

OTHER PUBLICATIONS

German Search Report for Counterpart DE102014107696.6, dated Feb. 3, 2015.

* cited by examiner

*Primary Examiner* — Jason Ko
*Assistant Examiner* — Spencer Bell

(57) ABSTRACT

A laundry treating appliance for treating a load of laundry according to an automatic cycle of operation includes a cabinet and a vessel, such as a tub or drum, suspended within the cabinet. An embossed pattern is provided on at least one wall or panel of the cabinet to complement the outer peripheral shape of the vessel.

12 Claims, 8 Drawing Sheets

LAUNDRY TREATING APPLIANCE

BACKGROUND

Laundry treating appliances, such as clothes washers, refreshers, and non-aqueous systems, may have a configuration based on a rotating drum that defines a treating chamber in which laundry items are placed for treating. The laundry treating appliance may have a controller that implements a number of pre-programmed cycles of operation having one or more operating parameters. The controller may control a motor to rotate the drum according to one of the pre-programmed cycles of operation. The rotating drum is housed in a cabinet having one or more side panels which are commonly made of sheet metal. During operation, as the drum rotates the side panels can vibrate, often leading to excess noise.

BRIEF SUMMARY

According to an embodiment of the invention a laundry treating appliance for treating laundry according to an automatic cycle of operation includes a cabinet having at least one planar panel defining an interior, a vessel suspended within the interior and having an outer periphery with a curved portion, and an embossed pattern provided on the at least one panel and having a profile that is complementary to the curved portion.

DETAILED DESCRIPTION

The invention relates to laundry treating appliances, and more specifically to an apparatus for controlling vibration and/or noise in a laundry treating appliance.

Figure 1:
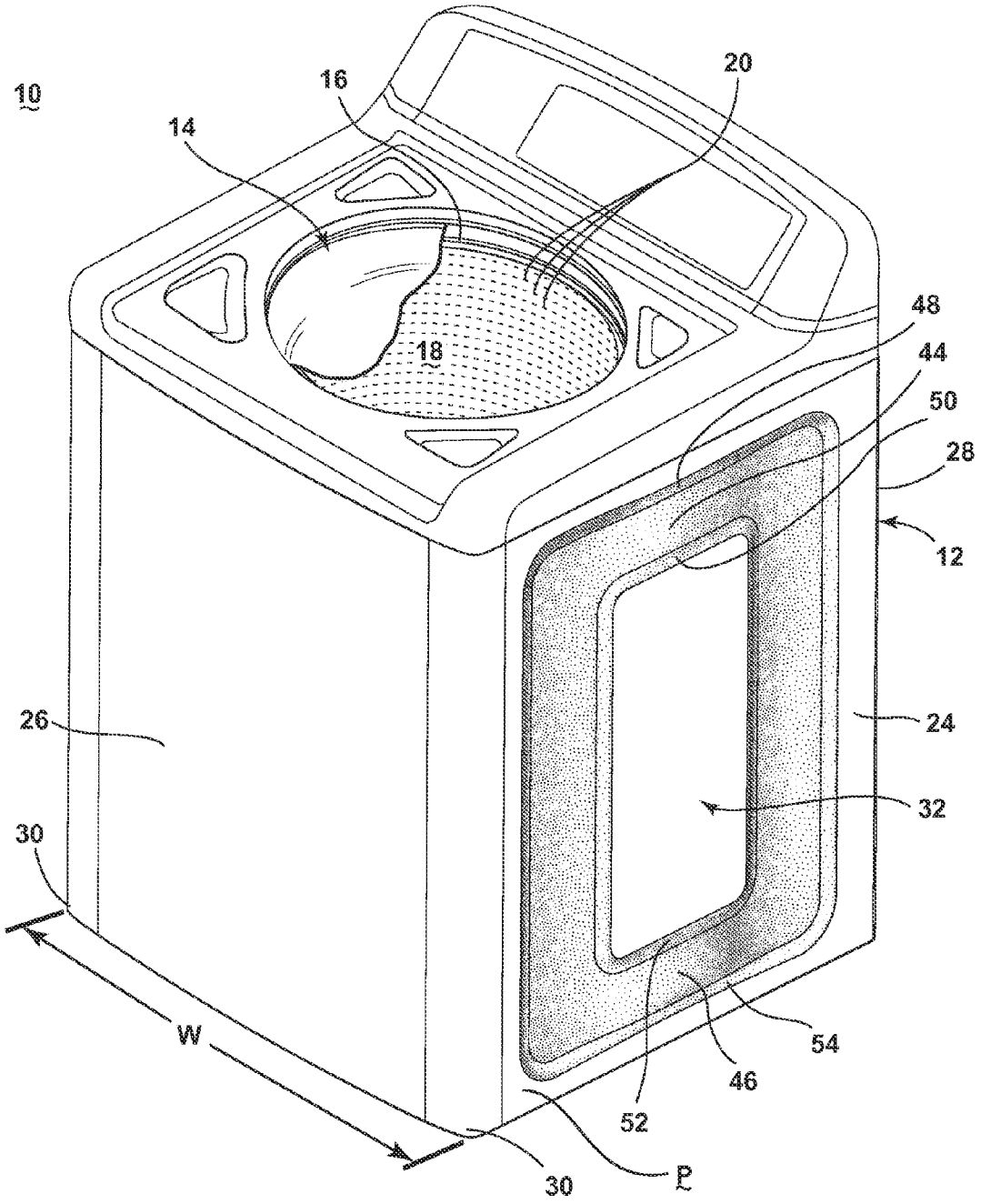
FIG. 1 is a perspective view of a laundry treating appliance according to a first embodiment of the invention.

FIG. 1 is a schematic view of a laundry treating appliance 10 according to a first embodiment of the invention. The laundry treating appliance 10 may be any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

The laundry treating appliance 10 of FIG. 1 is illustrated as a vertical-axis washing machine, which may include a structural support system comprising a cabinet 12, which may be a housing having a chassis and/or a frame, defining an interior within which a laundry holding system resides. The laundry treating appliance 10 described herein shares many features of a traditional automatic clothes washing machine, such as motors, pumps, fluid lines, controls, sensors, transducers, and the like, which will not be described in detail except as necessary for a complete understanding of the invention.

The laundry holding system includes a vessel within the cabinet 12. For the washing machine shown herein, the vessel is a tub 14 supported within the cabinet 12 by a suitable suspension system. The washing machine also includes a drum 16 provided within the tub 14 that defines at least a portion of a laundry treating chamber 18 for receiving a laundry load for treatment. The drum 16 may include a plurality of perforations 20 such that liquid may flow between the tub 14 and the drum 16 through the perforations 20. While not shown for clarity, the laundry holding system may further include a door which may be movably mounted to the cabinet 12 to selectively close both the tub 14 and the drum 16.

For another type of laundry treating appliance 10, the vessel within the cabinet 12 may differ. For example, in the case of a clothes dryer, the vessel can be a drum supported within the cabinet 12 by a suitable suspension system, the drum defining at least a portion of the laundry treating chamber 18. A separate tub is not provided.

The cabinet 12 comprises opposing side walls or panels 24 attached to the lateral sides of the laundry treating appliance 10 and a front wall or panel 26 attached to the front of the laundry treating appliance 10 and sharing a common edge with each side panel 24. A back wall or panel 28 can be attached to a back of the laundry treating appliance 10. The panels 24, 26, 28 are typically mounted to the chassis/frame and protect a user from the electrical and mechanical systems of the laundry treating appliance 10, and may additionally serve as a sound buffer or other aesthetic purposes.

The side and front panels 24, 26 can be made from a single piece of sheet metal, with bent corners 30 at the common edges between the front panel 26 and side panels 24 defining the boundaries of each panel 24, 26. Alternatively, each panel 24, 26 can be an individual piece or sheet attached to the laundry treating appliance 10 during manufacture.

The side panel 24 can include an embossed pattern 32 that complements the tub 14 such that the capacity of the tub 14 can be maximized without increasing the footprint of the laundry treating appliance 10. The embossed pattern 32 can further be configured to control vibration in the laundry treating appliance 10 by increasing stiffness of the side panel 24 to raise the first natural frequency of the side panel 24. In the laundry treating appliance 10, the primary driving frequency is created by the rotation of the drum 16. During a cycle of operation, the drum 16 may agitate and spin at various frequencies and speeds in order to clean the laundry load in the treating chamber 18 and prepare the laundry load for drying. The operating frequency of the laundry treating appliance 10 is equivalent to the rotational frequency of the drum 16 during operation. During a high-speed spin cycle, the rotational frequency of the drum 16 may range from 0-25 Hz, or more depending on the system design. The embossed patterns 32 on the side panels 24 disclosed herein can increase the natural frequency of the side panel 24 to avoid resonant vibration caused by rotation of the drum 16.

FIG. 1 is shaded to more clearly depict the features of the embossed pattern 32. The embossed pattern 32 includes one or more formations that are embossed or stamped into the side panel 24 during manufacture. However, the formations may be formed using any other suitable method, such as molding, shaping, or bending, for example. In the illustrated embodiment, the side panel 24 is made from a thin sheet of steel or other metal that can be permanently deformed by matched male and female dies. In one example, the side panel is made of structural, cold-rolled steel with a substantially uniform thickness of approximately 0.7 mm. Other thicknesses and materials may also be used, such as aluminum, galvanized steel, an alloy, plastic, other compound, or a multilayer composite, for example.

The side panel 24 lies along a major plane P that, together with the corresponding major plane P of the opposing side panel 24, defines the width W of the laundry treating appliance 10. The major plane P can be useful for differentiating between the formations of the embossed pattern 32. In the illustrated embodiment, the side panel 24 has a peripheral edge 34 extending around the four peripheral sides of the side panel 24, and which is coplanar with the major plane P. In this case, the peripheral edge 34 generally defines the major plane P of the side panel 24. In the case of a vertical-axis laundry treating appliance 10 as shown herein, the major plane P can be parallel to the axis of rotation of the tub 14.

The formations of the embossed pattern 32 can be defined with respect to the major plane P of the side panel 24, and can include a set of plains, valleys, slopes, and/or washouts. Generally, plains are level areas that are not significantly lower or higher than the major plane P, and when manufacture is complete, appear as coplanar formations with respect to the major plane P. Valleys are indented areas that are significantly lower than the major plane P, and when manufacture is complete, appear as depressed formations with respect to the major plane P, from the outside of the side panel 24. Slopes are transitional areas that connect a plain with a valley. When manufacture is complete, slopes may appear as an angled or curved transition between the two formations. Washouts are areas of depth variation in a valley or slope, where a valley or slope can expands outwardly toward the major plane P. With respect to the major plane P, the terms "lower" or "inner" and variations thereof are used to indicate the direction toward the inside of the laundry treating appliance 10, i.e. toward the axis of rotation of the tub 14, while the term "higher" or "outward" and variations thereof are used to indicate the direction away from the inside of the laundry treating appliance 10.

Figure 2:
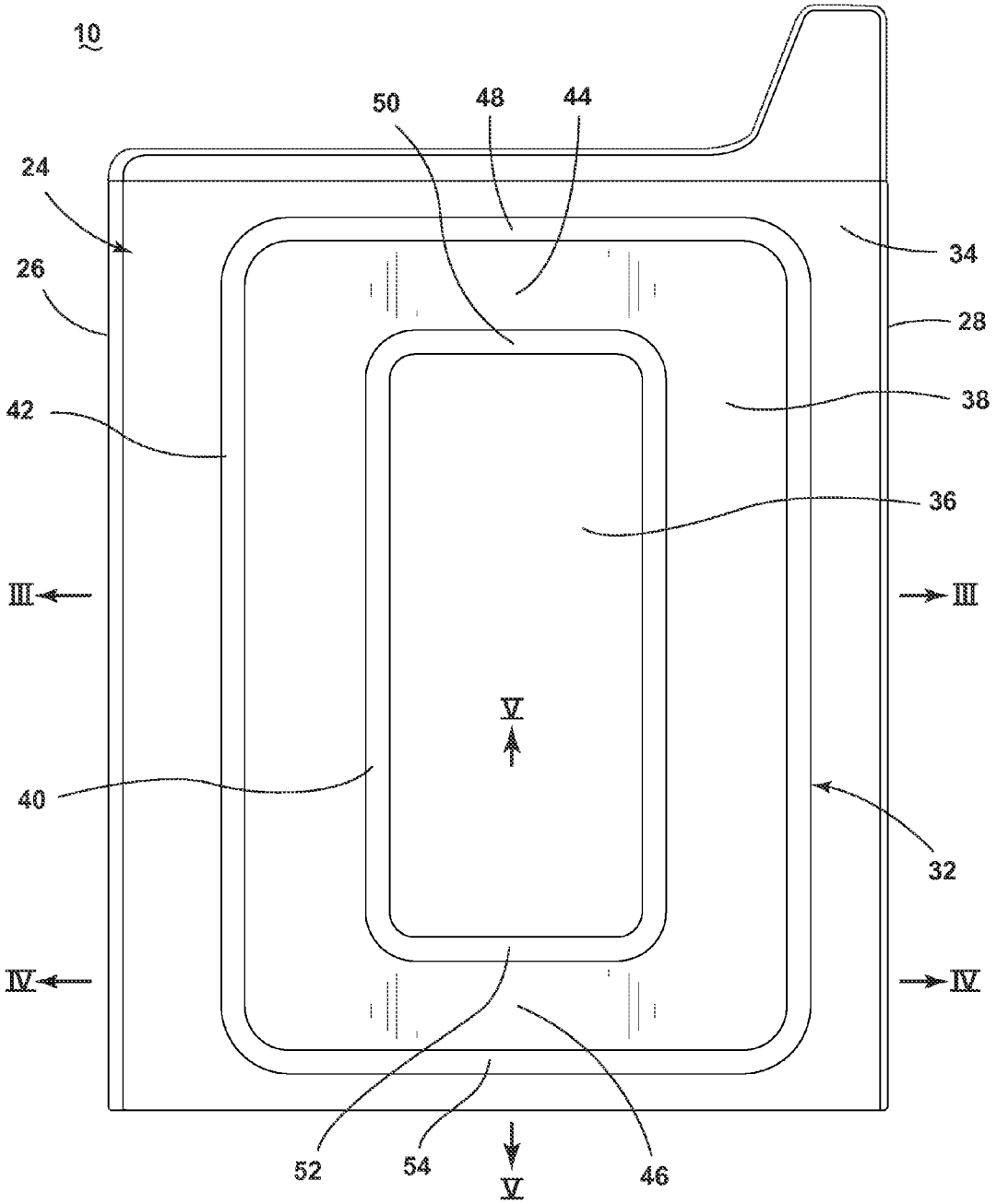
FIG. 2 is a side view of the laundry treating appliance from FIG. 1.

FIG. 2 is a front view of the side panel 24 from FIG. 1. The embossed pattern 32 can extend exclusively inwardly from the major plane P, and can be composed of a combination of valleys and plains, with no formations projecting beyond the major plane P. The illustrated embossed pattern 32 includes a central plain 36 and a valley 38 around the central plain 36. The central plain 36 can be an elongated formation with a height of the central plain 36 extending the better part of height of the side panel 24, and a width of the central plain 36 being less than its height. The central plain 36 can be generally rectilinear in shape, with rounded corners and generally straight sides.

The valley 38 can be a continuous channel around the central plain 36, and can have a looped or "O" shape. An inner slope 40 connects the valley 38 to the central plain 36, while an outer slope 42 connects the valley 38 to the peripheral edge 34 of the side panel 24. Both slopes 40, 42 can be a curved, generally concave transition between the formations. Like the valley 38, the slopes 40, 42 can have a continuous looped or "O" shape that conforms to the shape of the valley 38 around the central plain 36.

The illustrated embossed pattern 32 further includes an upper valley washout 44 and a lower valley washout 46 at the upper and lower sides of the looping valley 38 located at the top and bottom of the central plain 36, respectively. Corresponding slope washouts 48-54 are formed in the inner and outer slopes 40, 42 and are adjacent to the valley washouts 44, 46.

Figure 3:
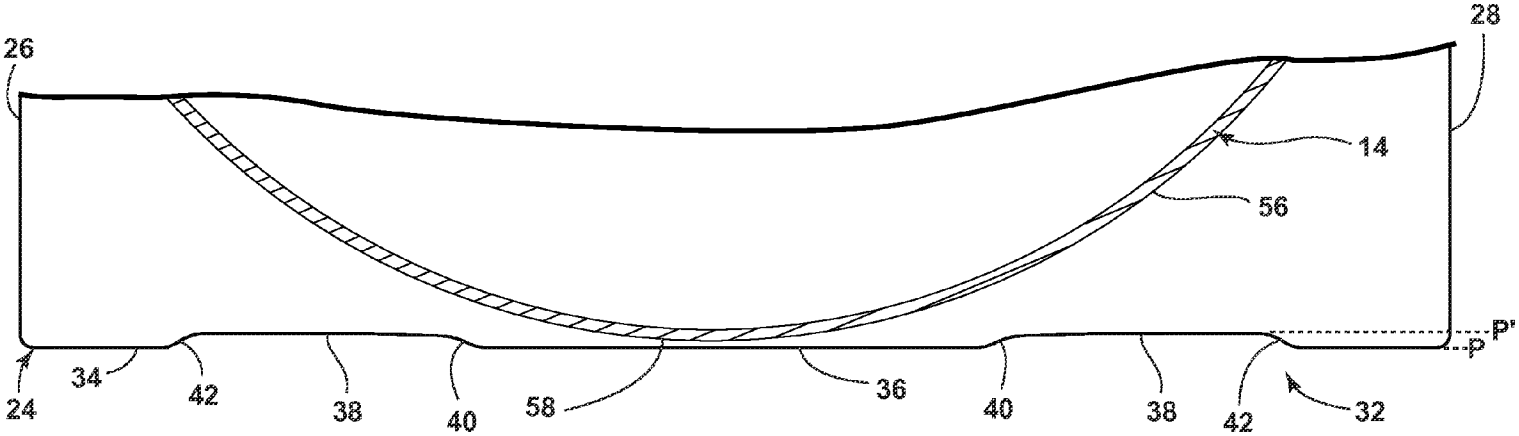
FIG. 3 is a sectional contour view of a portion of the laundry treating appliance taken through line III-III of FIG. 2.
Figure 4:
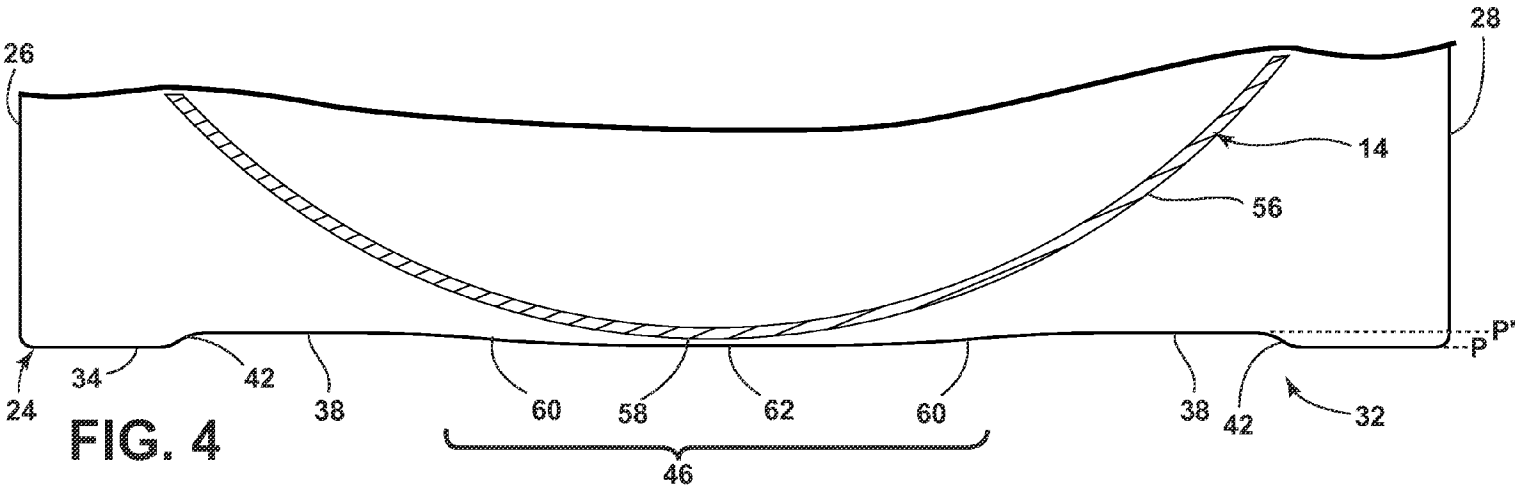
FIG. 4 is a sectional contour view of a portion of the laundry treating appliance taken through line IV-IV of FIG. 2.
Figure 5:
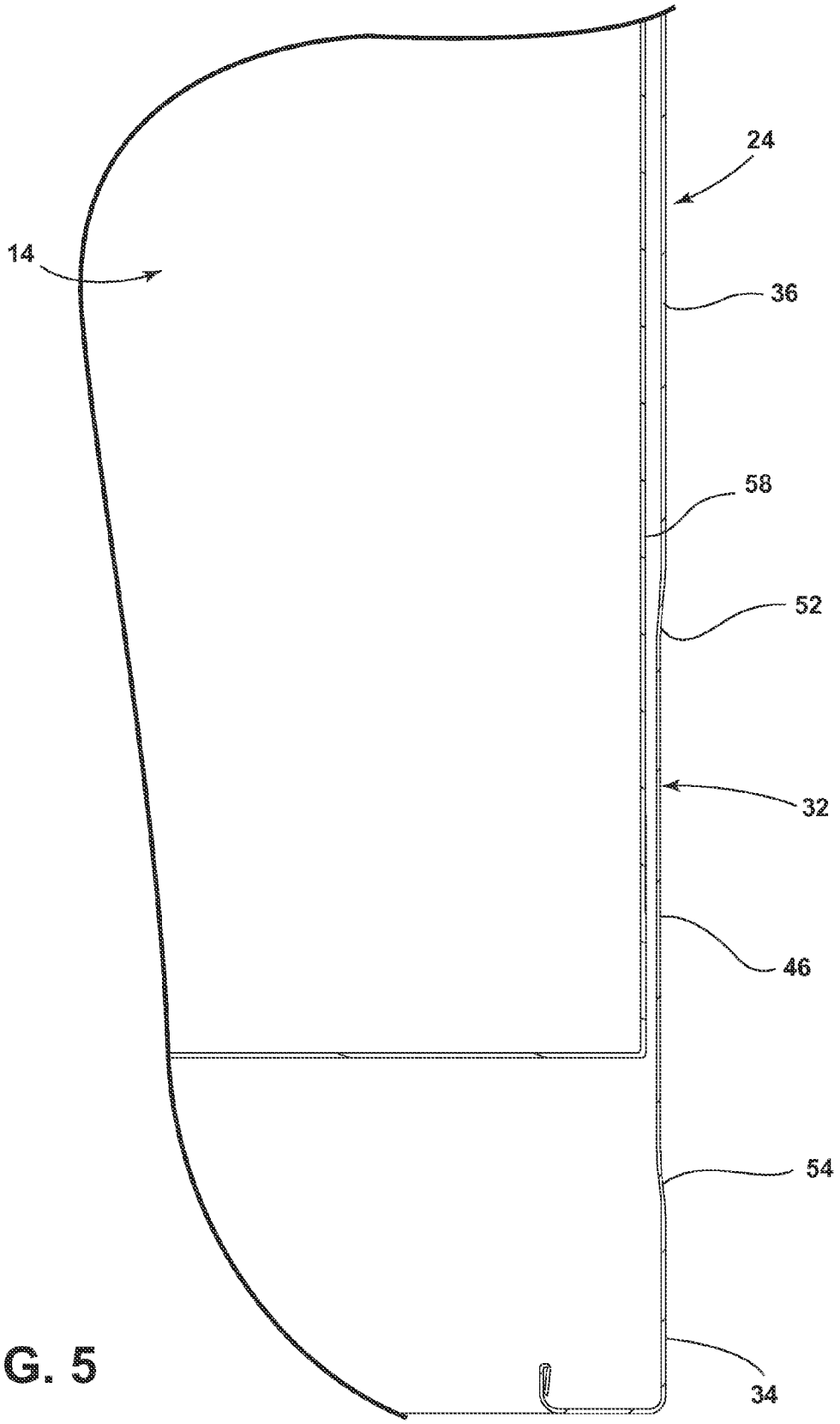
FIG. 5 is a sectional contour view of a portion of the laundry treating appliance taken through line V-V of FIG. 2.

FIGS. 3-5 are sectional contour views showing the contour of the side panel 24 with respect to the tub 14 at lines III-III, IV-IV, and V-V of FIG. 2, respectively. FIGS. 3-5 are not true cross-sectional views since only the contour of the side panel 24 and tub 14 that intersect with lines III-III, IV-IV, and V-V are shown; other features of the laundry treating appliance 10, including features of the side panel 24 and tub 14 that below the lines III-III, IV-IV, and V-V are not shown for clarity.

The embossed pattern 32 can be optimized to balance several considerations, including the capacity of the treating chamber 18, the stiffness of the side panel, and the width of the laundry treating appliance 10. The capacity of the treating chamber 18 relates to the amount of laundry that can be treated at a time, and is directly related to the dimensions of the tub 14. A larger tub 14 allows for a larger treating chamber 18. The stiffness of the side panel 24 is directly related to the harmonic or natural frequency of the side panel 24. The width W of the laundry treating appliance 10 is preferably tailored to fit within standard-sized doorways in user's homes; some exemplary widths W include 27-29 inches.

The combination of the central plain 36 and valley 38 increase the stiffness of the side panel 24. Specifically, the central plain 36 and valley 38 can be configured to raise the first natural frequency of the side panel 24 above any operating frequency of the laundry treating appliance 10. The central plain 36 is coplanar with the peripheral edge 34, and so lies in the major plane P of the side panel 24. The valley 38 is lower than the central plain 36 and peripheral edge 34, and lies in a minor plane P' of the side panel 24 that is spaced from but parallel to the major plane P. The distance between the major and minor planes P, P' can correspond to an embossment depth of the valley 38. The depth profiles of the valley 38 may vary according to the design. Although exceptions may exist, a greater embossed depth of the valley 38 generally results in a greater first natural frequency of the side panel 24. In the illustrated embodiment, the valley 38 may be embossed at approximately 6-9 mm, and more specially at 8 mm, below the major plane P. Other embossing patterns may be used to increase the first natural frequency of the side panel 24.

The tub 14 includes an outer periphery 56 with a curved portion 58 that faces the side panel 24. The tub 14 may be substantially cylindrical in shape, although some deviation from a completely cylindrical outer periphery 56 is possible. As noted above, the tub 14 is suspended within the interior of the laundry treating appliance 10, and is spaced from the side panel 24 by a clearance gap. However, during operation of the laundry treating appliance 10, especially when the drum 16 is rotating, the tub 14 may be displaced due to vibration from the drum 16, and the clearance gap correspondingly may become larger or smaller.

The clearance gap between the tub 14 and side panel 24 is maintained using the embossed pattern 32, such that a larger tub 14 allowing for a larger capacity treating chamber can be used while still preventing the tub 14 from striking the side panel 24 during operation of the laundry treating appliance 10 and still keeping the width W of the laundry treating appliance 10 to a reasonable dimension. The embossed pattern 32 can be configured to accommodate the larger tub 14, and can have at least one formation that is complementary to the curved portion 58 of the tub 14, so that the clearance gap remains present even during periods of high tub displacement, such that the tub 14 does not strike the side panel 24. In one example, the radius of the tub 14 can be increased by 5-8 mm using the embossed pattern 32 disclosed herein.

Here, the embossed pattern 32 is selectively shaped, such as "washed out", in predetermined areas to accommodate the tub. The provisions of washouts 44-56 varies the depth of the embossed valley 38 and slopes 40, 42 as needed to accommodate the tub 14 and meet the stiffness requirements of the side panel 24. The tub 14 can be spaced inwardly of the side panel 24 such that the curved portion 58 of the tub 14 does not cross the minor plane P' of the side panel 24. Alternatively, the tub 14 can project beyond a portion of the side panel 24 such that at least the curved portion 58 of the tub 14 lies between the major and minor planes P, P' of the side panel 24.

In the illustrated embodiment, the washouts 44-56 are complementary to the curved portion 58 of the tub 14. The central plain 36 accommodates the outer periphery of the tub 14, as seen in FIG. 3, but the valley 38 does not, and so must be washed out along the center of the side panel 24, as seen in FIG. 4, with the provision of the washouts 44, 46 to accommodate the tub 14. In areas where tub clearance is not a factor, such as near the outer portions of the side panel 24 where the tub 14 curves away from the side panel 24, the depth of the valleys can be maximized to order to increase the stiffness of the side panel 24.

In being complementary, the washouts 44-56 can have a similar or identical radius of curvature as the tub 14, although some deviation is possible. For example, the upper valley washout 44 includes outer curved portions 60 and a central flat portion 62, where the outer curved portions 60 have a similar or identical radius of curvature as the tub 14, while the flat portion 62 does not. The lower valley washout 46 can have a similar contour as the upper valley washout 44. The valley washouts 44, 46 bring the valley 38 from the minor plane P' to or almost to the major plane P, although some depth variation from the major plane P is possible; for example at the center of the valley washouts 44, 46, the valley washouts 44, 46 may have an embossment depth of approximately 0.5 to 1 mm. The embossment depth may more specifically correspond to the sheet thickness of the side panel 24, and may be approximately 0.7 mm.

Figure 6:
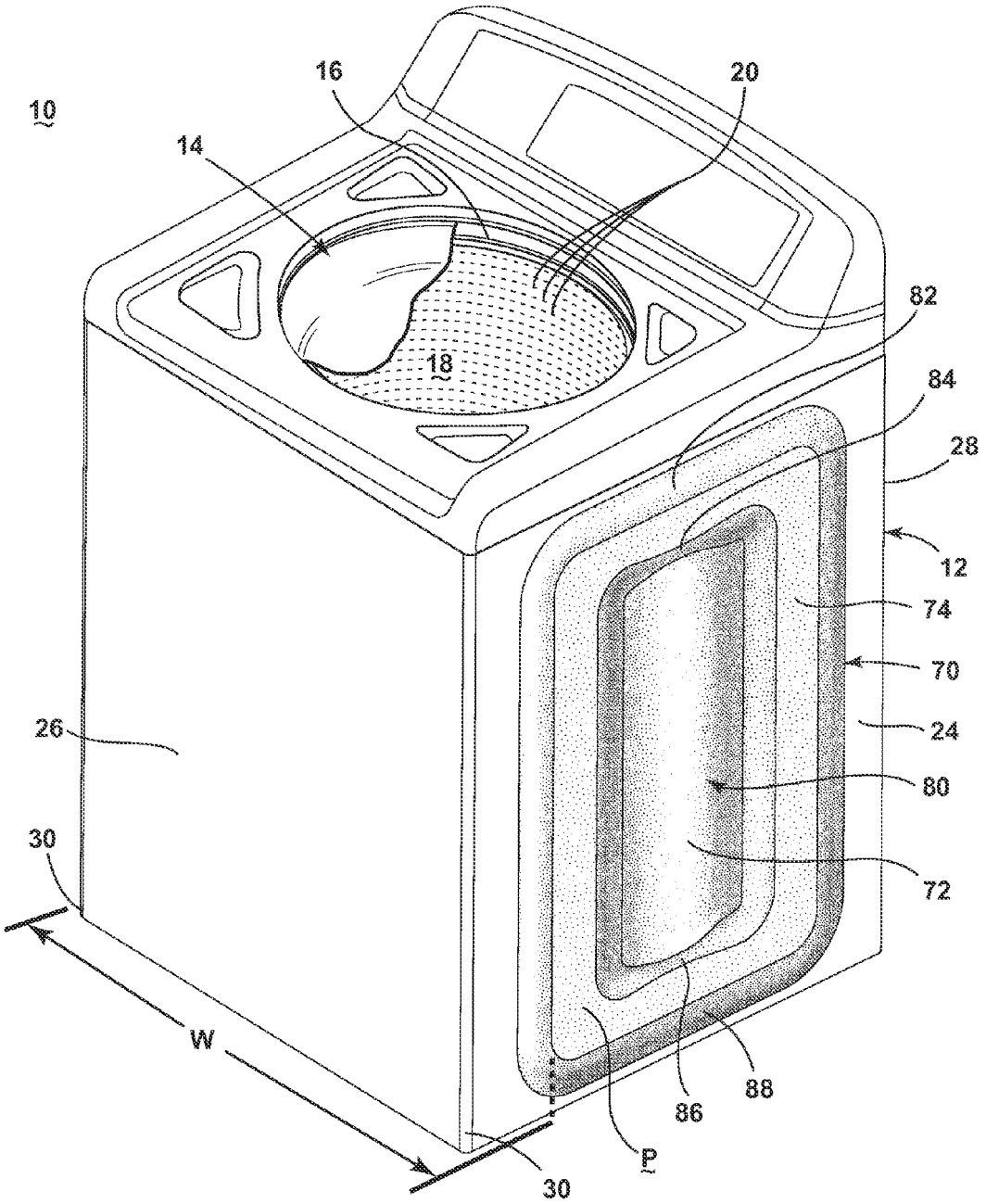
FIG. 6 is a perspective view of a laundry treating appliance according to a second embodiment of the invention.

FIG. 6 is a schematic view of the laundry treating appliance 10 according to a second embodiment of the invention. The laundry treating appliance 10 may be substantially similar to the laundry treating appliance 10 shown in FIG. 1, with the exception of the side panels 24. Here, the side panels 24 have an embossed pattern 70 that, like the embossed pattern 32, is configured to complement the tub 14 and control the vibration in the laundry treating appliance 10. FIG. 6 is shaded to more clearly depict the features of the embossed pattern 70.

Figure 7:
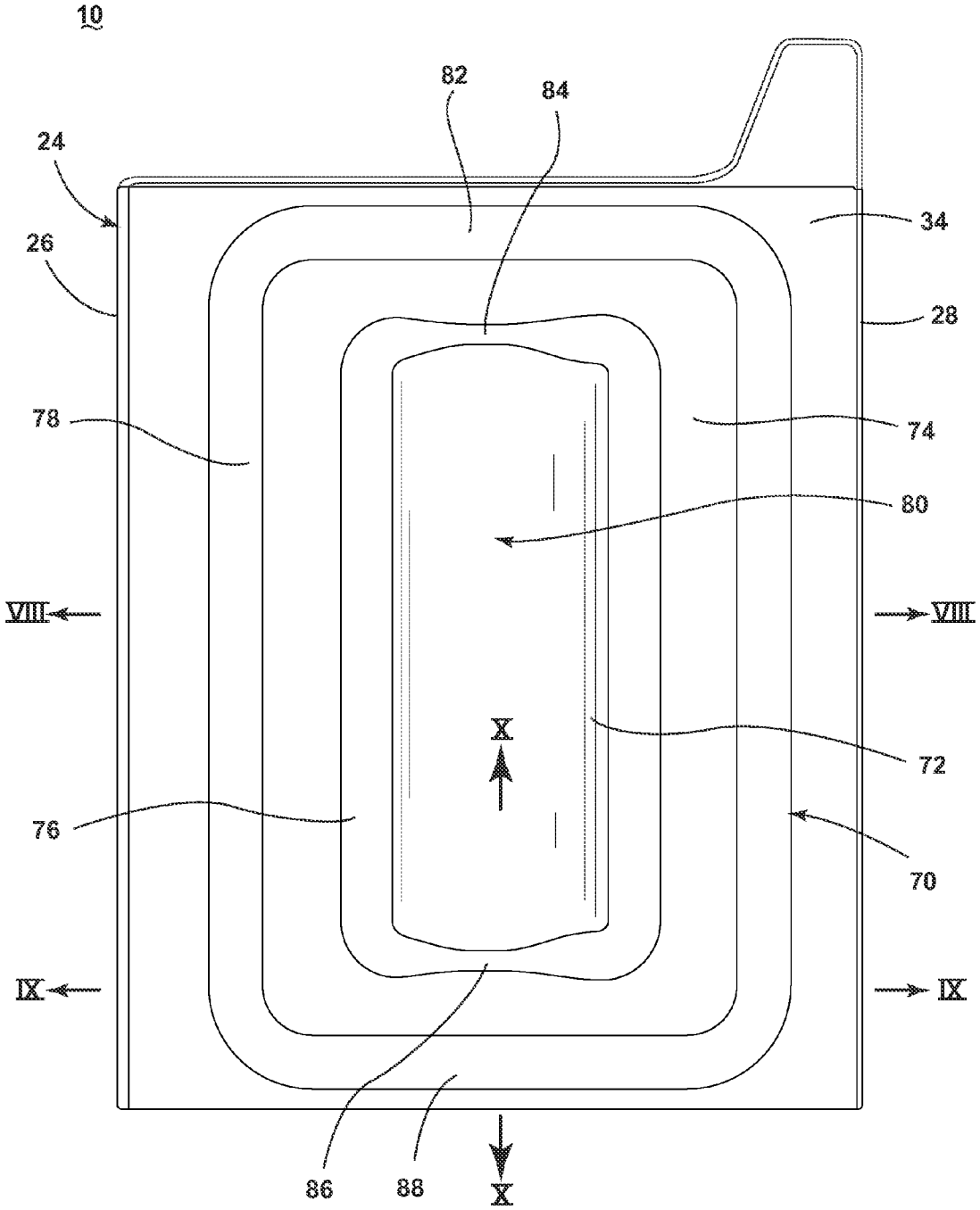
FIG. 7 is a side view of the laundry treating appliance from FIG. 6.

FIG. 7 is a front view of the side panel 24 from FIG. 6. The embossed pattern 70 can extend exclusively inwardly from the major plane P, and can be composed of a combination of valleys and plains, with no formations projecting beyond the major plane P. The illustrated embossed pattern 70 includes a central valley 72 and a plain 74 around the central valley 72. The central valley 72 can be an elongated formation with a height of the central valley 72 extending the better part of height of the side panel 24, and a width of the central valley 72 being less than its height. The central valley 72 can be generally rectilinear in shape, with rounded corners and straight or curving sides.

The plain 74 can be a continuous ridge around the central valley 72, and can have a looped or "O" shape. An inner slope 76 connects the plain 74 to the central valley 72, while an outer slope 78 connects the plain 74 to the peripheral edge 34 of the side panel 24. Both slopes 76, 78 can be a curved, generally concave transition between the formations. Like the plain 74, the slopes 76, 78 can have a continuous looped or "O" shape that conforms to the shape of the plain 74 around the central valley 72.

The illustrated embossed pattern 70 further includes a valley washout 80 at the center of the central valley 72, extending from the top to the bottom of the central valley 72. Corresponding slope washouts 82-88 are formed in the inner and outer slopes 76, 78 and are adjacent to the valley washout 80.

Figure 8:
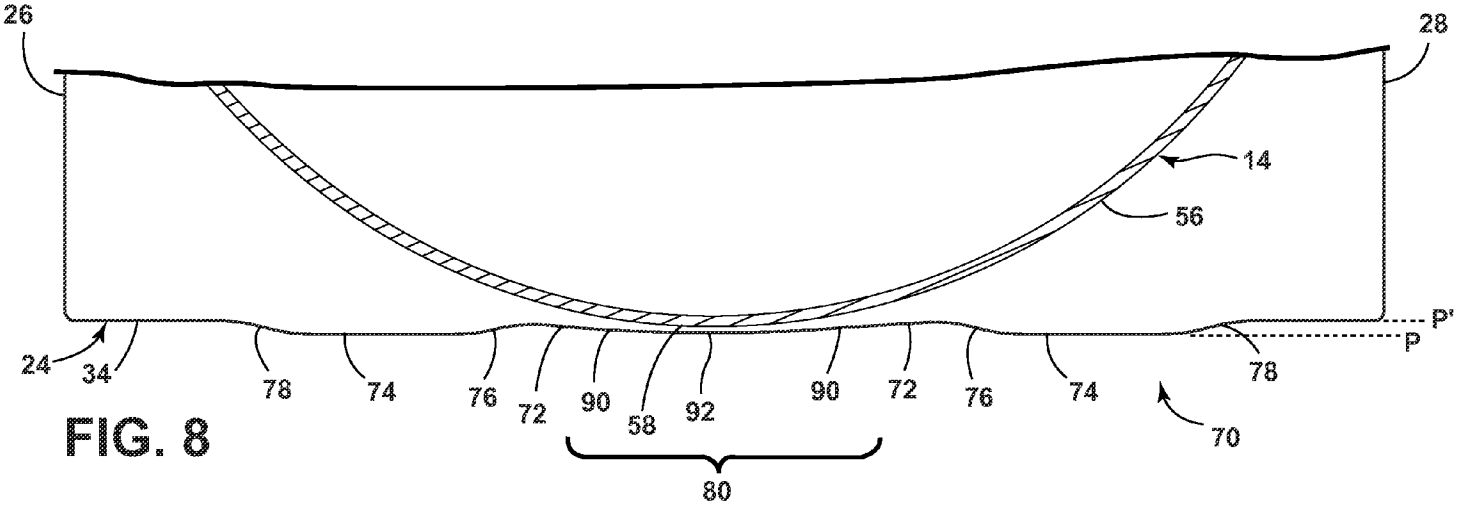
FIG. 8 is a sectional contour view of a portion of the laundry treating appliance taken through line VIII-VIII of FIG. 7.
Figure 9:
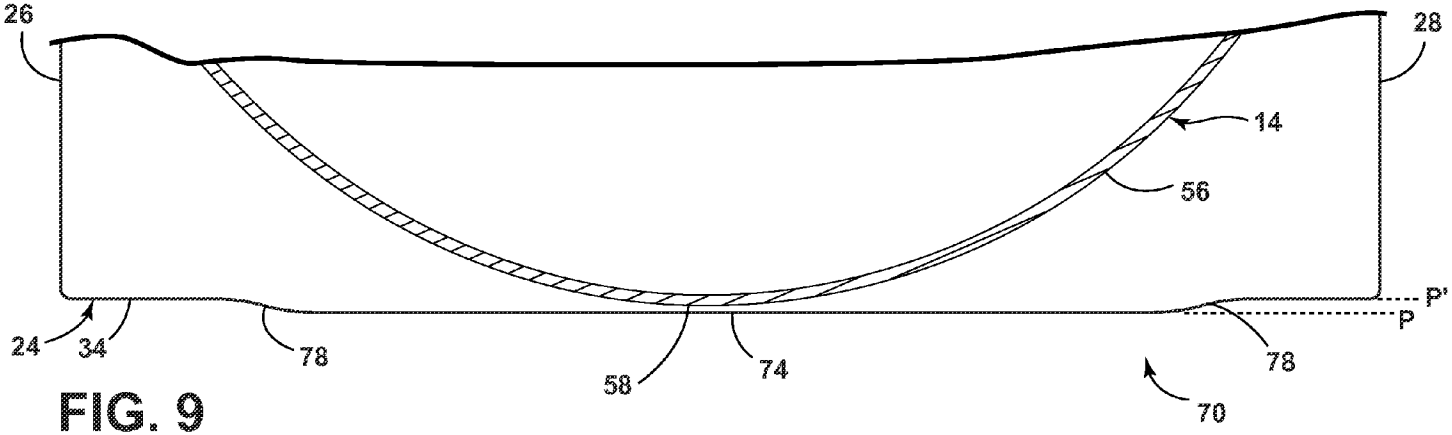
FIG. 9 is a sectional contour view of a portion of the laundry treating appliance taken through line IX-IX of FIG. 7.
Figure 10:
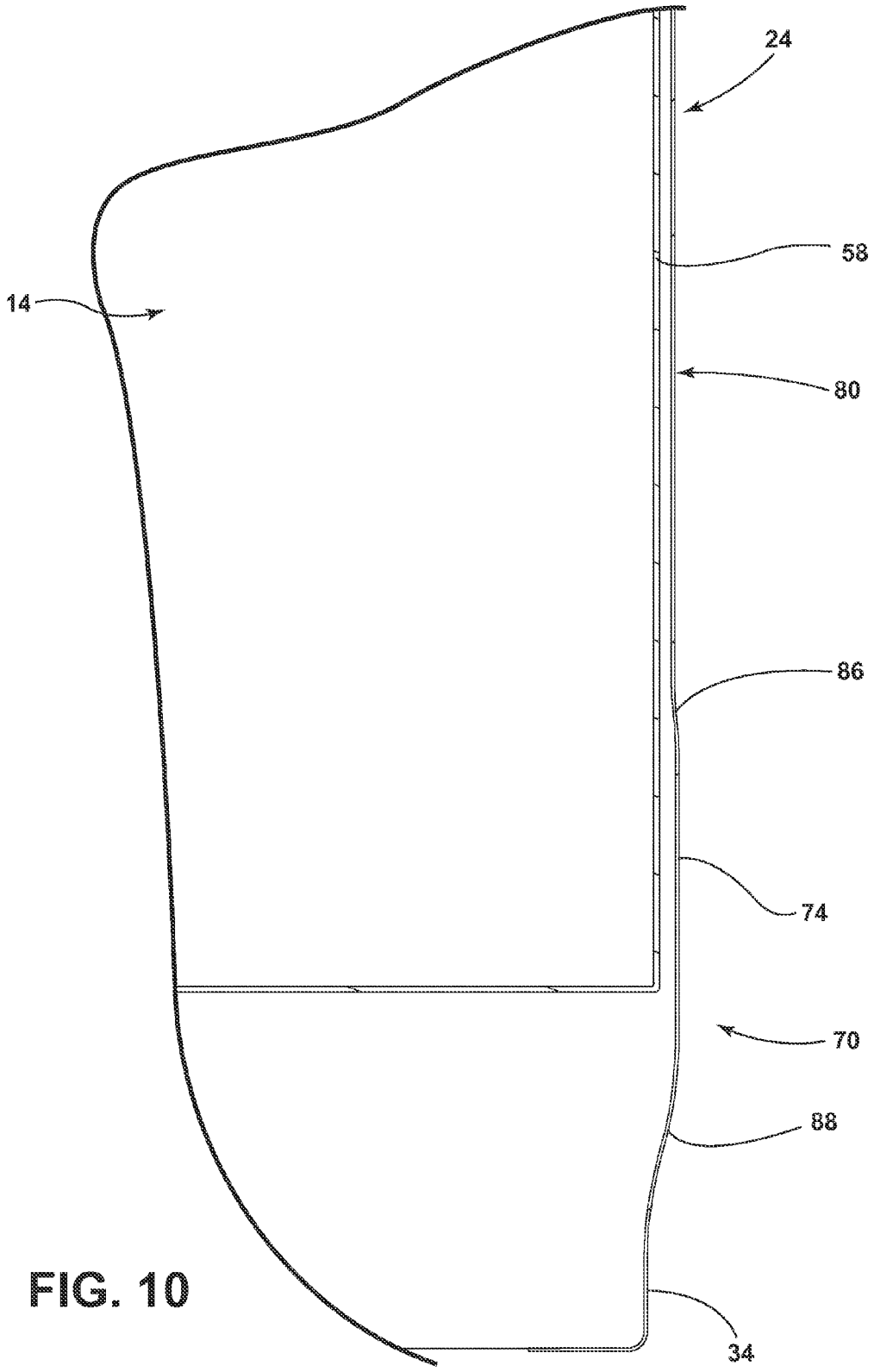
FIG. 10 is a sectional contour view of a portion of the laundry treating appliance taken through line X-X of FIG. 7.

FIGS. 8-10 are sectional contour views showing the contour of the side panel 24 with respect to the tub 14 at lines VIII-VIII, IX-IX, and X-X of FIG. 7, respectively. FIGS. 8-10 are not true cross-sectional views since only the contour of the side panel 24 and tub 14 that intersect with lines VIII-VIII, IX-IX, and X-X are shown; other features of the laundry treating appliance 10, including features of the side panel 24 and tub 14 that below the lines VIII-VIII, IX-IX, and X-X are not shown for clarity.

Like the embossed pattern 32 of the first embodiment, the embossed pattern 70 is optimized to balance the capacity of the treating chamber 18, the stiffness of the side panel, and the width of the laundry treating appliance 10. In the second embodiment, the combination of the central valley 72 and plain 74 increase the stiffness of the side panel 24. Specifically, the central valley 72 and plain 74 can be configured to raise the first natural frequency of the side panel 24 above any operating frequency of the laundry treating appliance 10. In the illustrated embodiment, the looping plain 74 generally defines the major plane P. The peripheral edge 34, like the central valley 72, is not coplanar with the major plane P, but is rather below the major plane P. The central valley 72 and the peripheral edge 34 both lie in a minor plane P' of the side panel 24 that is spaced from but parallel to the major plane P. The distance between the major and minor planes P, P' can correspond to a maximum embossment depth of the central valley 72. The depth profiles of the central valley 72 may vary according to the design. Although exceptions may exist, a greater embossed depth of the central valley 72 generally results in a greater first natural frequency of the side panel 24. In the illustrated embodiment, the central valley 72 is embossed at maximum depth near the inner slope 76 of approximately 4-9 mm, and more specifically 6 mm, below the major plane P. Other embossing patterns may be used to increase the first natural frequency of the side panel 24.

Also in the second embodiment, the clearance gap between the tub 14 and side panel 24 is minimized by selectively shaping the embossed pattern 70 with washouts 80-88 in predetermined areas to accommodate the tub 14.

The provisions of washouts 80-88 varies the depth of the embossed valley 72 and slopes 78, 76 as needed to accommodate the tub 14 and meet the stiffness requirements of the side panel 24. Like the first embodiment, the tub 14 can be spaced inwardly of the side panel 24 such that the curved portion 58 of the tub 14 does not cross the minor plane P' of the side panel 24. Alternatively, the tub 14 can project beyond a portion of the side panel 24 such that at least the curved portion 58 of the tub 14 lies between the major and minor planes P, P' of the side panel 24.

In the illustrated embodiment, the washouts 80-88 are complementary to the curved portion 58 of the tub 14. The outer plain 74 accommodates the outer periphery of the tub 14, as seen in FIG. 9, but the central valley 72 does not, and so must be washout out along the center of the side panel 24, as seen in FIG. 8, with the provision of the washouts 80 to accommodate the tub 14. In areas where tub clearance is not a factor, such as near the inner slope 76 where the tub 14 curves away from the side panel 24, the depth of the central valley 72 can be maximized to order to increase the stiffness of the side panel 24.

In being complementary, the washouts 80-88 can have a similar or identical radius of curvature as the tub 14, although some deviation is possible. For example, the valley washout 80 includes outer curved portions 90 and a central flat portion 92, where the outer curved portions 90 have a similar or identical radius of curvature as the tub 14, while the flat portion 92 does not. The valley washout 80 brings the central valley 72 from the minor plane P' to or almost to the major plane P in a localized area along the middle of the side panel 24, although some depth variation from the major plane P is possible; for example at the center of the valley washouts 44, 46, the valley washouts 44, 46 may have an embossment depth of approximately 0.5 to 1.5 mm below the major plane P.

The laundry treating appliance 10 having the embossed pattern 32, 70 disclosed herein offers a unique solution to the conflicting problems of load capacity and vibration control. One advantage that may be realized in the practice of some embodiments of the described laundry treating appliance 10 and embossed patterns 32, 70 is that the tub size is maximized while not sacrificing panel stiffness or the necessary clearance between the tub and side panel by providing a profile that accommodates and complements the tub. Previous cabinets may have embossments, but the embossments are not profiled with the tub. Existing solutions to the problem of tub capacity minimize the depth of embossed formations. However, this solution is not ideal because reduces the panel stiffness and can result in increased sound and vibration.

Another advantage that may be realized in the practice of some embodiments of the described laundry treating appliance 10 and embossed patterns 32, 70 is that all of the formations protrude inward, i.e. toward the center of the laundry treating appliance. This offers vibration reduction while not adding width to the appliance, and reduces customer difficulty in home installation through doorways. Also, the formations have a curvature at points closest to the tub to allow maximum tub displacement without contacting the side panels, yet maximum emboss depth in the areas where tub clearance is not a concern. Embossed formations used in current laundry treating appliances have uniform depth for a given feature. This does not result in optimal use of space or stiffness of the panel.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance for treating laundry according to an automatic cycle of operation comprising:

a cabinet having at least one planar panel defining an interior, the at least one planar panel having a first portion lying along a major plane and a second portion lying along a minor plane that is spaced inwardly from the major plane;

a vessel suspended within the interior and having an outer periphery with a curved portion; and an embossed pattern provided on the at least one panel and comprising:

a center formation;

a valley comprising a channel that extends continuously around the center formation and that is spaced inwardly from the major plane;

an inner slope connecting the valley to the center formation;

an outer slope connecting the valley to the first portion of the planar panel lying along the major plane; and at least one curved portion located in the valley between the major and minor planes that curves outwardly away from the interior and extends vertically along the at least one planar panel, the at least one curved portion confronting the curved portion of the vessel and having a radius of curvature that complements the curved portion of the vessel;

wherein the vessel projects beyond the second portion of the at least one panel such that the curved portion of the vessel lies within the at least one curved portion between the major and minor planes of the at least one panel.

2. The laundry treating appliance from claim 1, wherein the embossed pattern extends inwardly from the major plane.

3. The laundry treating appliance from claim 1, wherein the embossed pattern comprises a washout where the embossed pattern expands toward the major plane.

4. The laundry treating appliance from claim 3, wherein the washout further comprises at least one flat portion that is not complementary to the curved portion of the vessel.

5. The laundry treating appliance from claim 1, wherein the embossed pattern has a depth at the at least one curved portion that is less than a maximum depth of the embossed pattern.

6. The laundry treating appliance from claim 1, wherein the center formation is located in the center of the at least one panel and is coplanar with the major plane.

7. The laundry treating appliance from claim 1, wherein the center formation comprises a flat plain adjacent the valley for raising the first natural frequency of the at least one planar panel.

8. The laundry treating appliance from claim 1, wherein the vessel comprises a tub, and further comprising a rotatable drum provided within the tub and defining at least a portion of a laundry treating chamber for receiving a laundry load for treatment, wherein the center formation is a flat portion configured to raise a first natural frequency of the at least one planar panel above a maximum driving frequency associated with a maximum rotational frequency of the drum.

9. The laundry treating appliance from claim 1, wherein the vessel comprises a drum defining at least a portion of a laundry treating chamber for receiving a laundry load for treatment.

10. The laundry treating appliance from claim 1, wherein the height of the embossed pattern is at least the height of the vessel.

11. The laundry treating appliance from claim 1, wherein the channel comprises an O-shaped channel, and the at least one curved portion comprises an upper curved portion at an upper side of the O-shaped channel between the inner and outer slopes, and a lower curved portion at a lower side of the O-shaped channel between the inner and outer slopes.

12. The laundry treating appliance from claim 1, wherein the at least one curved portion extends vertically through a center of the valley.

* * * * *